US010500841B2

(12) United States Patent
Nishitani et al.

(10) Patent No.: US 10,500,841 B2
(45) Date of Patent: Dec. 10, 2019

(54) INK JET RECORDING METHOD AND INK JET RECORDING APPARATUS

(71) Applicant: CANON KABUSHIKI KAISHA, Tokyo (JP)

(72) Inventors: Eisuke Nishitani, Tokyo (JP); Keiichirou Takeuchi, Komae (JP); Akira Morita, Yokohama (JP); Kanako Soma, Yokohama (JP); Takumi Otani, Yokohama (JP); Fumihiro Goto, Kawasaki (JP); Koichiro Nakazawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/021,622

(22) Filed: Jun. 28, 2018

(65) Prior Publication Data

US 2019/0009518 A1 Jan. 10, 2019

(30) Foreign Application Priority Data

Jul. 4, 2017 (JP) ..... 2017-131274

(51) Int. Cl.
*B41J 11/00* (2006.01)
*B41J 2/005* (2006.01)
(Continued)

(52) U.S. Cl.
CPC ..... *B41J 2/0057* (2013.01); *B41J 2/2114* (2013.01); *B41J 11/0015* (2013.01); *B41M 7/009* (2013.01)

(58) Field of Classification Search
USPC ..... 347/103, 104
See application file for complete search history.

(56) References Cited

U.S. PATENT DOCUMENTS 5,006,189 A * 4/1991 Tsukamoto ..... B41J 17/40 156/247
7,699,431 B2 4/2010 Nakazawa et al.
(Continued)

FOREIGN PATENT DOCUMENTS

EP 2 105 472 A1 9/2009
JP 2010-005815 A 1/2010

OTHER PUBLICATIONS

Extended European Search Report dated Nov. 28, 2018, in European Patent Application No. 18181423.7.

*Primary Examiner* — Lam S Nguyen
(74) *Attorney, Agent, or Firm* — Venable LLP

(57) ABSTRACT

An ink jet recording apparatus of the present invention includes an image forming unit which forms an ink image by discharging and applying ink containing at least a resin and a liquid component as an ink droplet onto a transfer body, a liquid removing unit which removes the liquid component in the ink image, a transfer unit which transfers removes the image, from which the liquid component is removed, onto a recording medium, a fixing unit which performs heating and pressing fixing on the image formed on the recording medium by pressing a fixing substrate, a liquid adhesion determination unit which determines whether a liquid adheres to a surface of the fixing substrate, and a liquid removing condition changing unit which changes a liquid removing condition of the liquid removing unit based on the determination result of the liquid adhesion determination unit.

20 Claims, 6 Drawing Sheets

(51) Int. Cl.
*B41J 2/21* (2006.01)
*B41M 7/00* (2006.01)

(56) References Cited

U.S. PATENT DOCUMENTS

| | | | | |
|---|---|---|---|---|
| 8,240,839 | B2 | 8/2012 | Yamanobe | |
| 9,067,449 | B2 | 6/2015 | Morita et al. | |
| 9,527,314 | B2 * | 12/2016 | Moriguchi | B41J 2/01 |
| 9,656,459 | B2 | 5/2017 | Kuwabara et al. | |
| 9,707,751 | B2 | 7/2017 | Nishitani et al. | |
| 9,925,802 | B2 | 3/2018 | Nishitani et al. | |
| 2005/0110854 | A1 * | 5/2005 | Roof | B41J 2/0057 347/103 |
| 2013/0300785 | A1 | 11/2013 | Tsuchiya et al. | |
| 2015/0273919 | A1 * | 10/2015 | Otani | B41J 2/195 347/19 |
| 2016/0303847 | A1 | 10/2016 | Soma et al. | |
| 2016/0303870 | A1 | 10/2016 | Moriguchi et al. | |
| 2017/0057245 | A1 | 3/2017 | Morita et al. | |
| 2019/0009551 | A1 | 1/2019 | Goto et al. | |
| 2019/0009578 | A1 | 1/2019 | Takeuchi et al. | |

* cited by examiner

INK JET RECORDING METHOD AND INK JET RECORDING APPARATUS

BACKGROUND OF THE INVENTION

Field of the Invention

The present invention relates to an ink jet recording method and an ink jet recording apparatus, and more particularly, to an ink jet recording method and an ink jet recording apparatus capable of suppressing a change in gloss of a recorded image.

Description of the Related Art

In an the ink jet recording method, a method for preparing an image by filming resin particles contained in ink on a recording medium has been proposed. In this method, ink containing resin particles is applied to a recording medium, a liquid component in the ink applied to the recording medium is removed, and then the recording medium is fixed by a heating and pressing unit. By using this method, it is possible to form the resin particles into a film, improve a scratch resistance of the recorded image and obtain an image with high gloss. Japanese Patent Application Laid-Open No. 2010-5815 discloses an image forming method capable of preventing an offset of ink to a fixing member or a curl of a recorded image and forming a higher-quality image by controlling the remaining amount of ink-derived water to be 4.0 g/m$^2$ or less after the drying, in an ink drying process of drying an ink layer before a fixing process of fixing the ink layer by heating and pressing the ink layer on a recording medium.

SUMMARY OF THE INVENTION

The present invention is directed to providing an ink jet recording apparatus and an ink jet recording method capable of forming an image that maintains high glossiness immediately after fixing even after the passage of time.

According to an aspect of the present invention, provided is an ink jet recording apparatus, including:

an ink image forming unit which forms an ink image by applying ink containing at least a resin and a liquid component onto a transfer body;

a liquid removing unit which removes at least a part of the liquid component in the ink image;

a transfer unit which transfers the ink image, from which at least a part of the liquid component is removed, onto a recording medium;

a fixing unit which performs heating and pressing fixing on the ink image formed on the recording medium by pressing a fixing substrate;

a liquid adhesion determination unit which determines whether a liquid adheres to a surface of the fixing substrate; and a liquid removing condition changing unit which changes a liquid removing condition of the liquid removing unit based on the determination result of the liquid adhesion determination unit.

According to another aspect of the present invention, provided is an ink jet recording apparatus, including:

an ink image forming unit which forms an ink image by applying ink containing at least a resin and a liquid component onto a recording medium;

a liquid removing unit which removes at least a part of the liquid component in the ink image;

a fixing unit which performs heating and pressing fixing on the ink image formed on the recording medium by pressing a fixing substrate;

a liquid adhesion determination unit which determines whether a liquid adheres to a surface of the fixing substrate; and a liquid removing condition changing unit which changes a liquid removing condition of the liquid removing unit based on the determination result of the liquid adhesion determination unit.

According to another aspect of the present invention, provided is an ink jet recording method, including:

forming an ink image by applying ink containing at least a resin and a liquid component onto a recording medium or a transfer body;

removing at least a part of the liquid component in the ink image from the ink image;

performing heating and pressing fixing on the ink image formed on the recording medium or the ink image transferred from the transfer body onto the recording medium by pressing a fixing substrate;

determining whether a liquid adheres to a surface of the fixing substrate; and changing a liquid removing condition of the removing of the liquid based on the determination result of the liquid adhesion determination unit.

Further features of the present invention will become apparent from the following description of exemplary embodiments with reference to the attached drawings.

DESCRIPTION OF THE EMBODIMENTS

Figure 1:
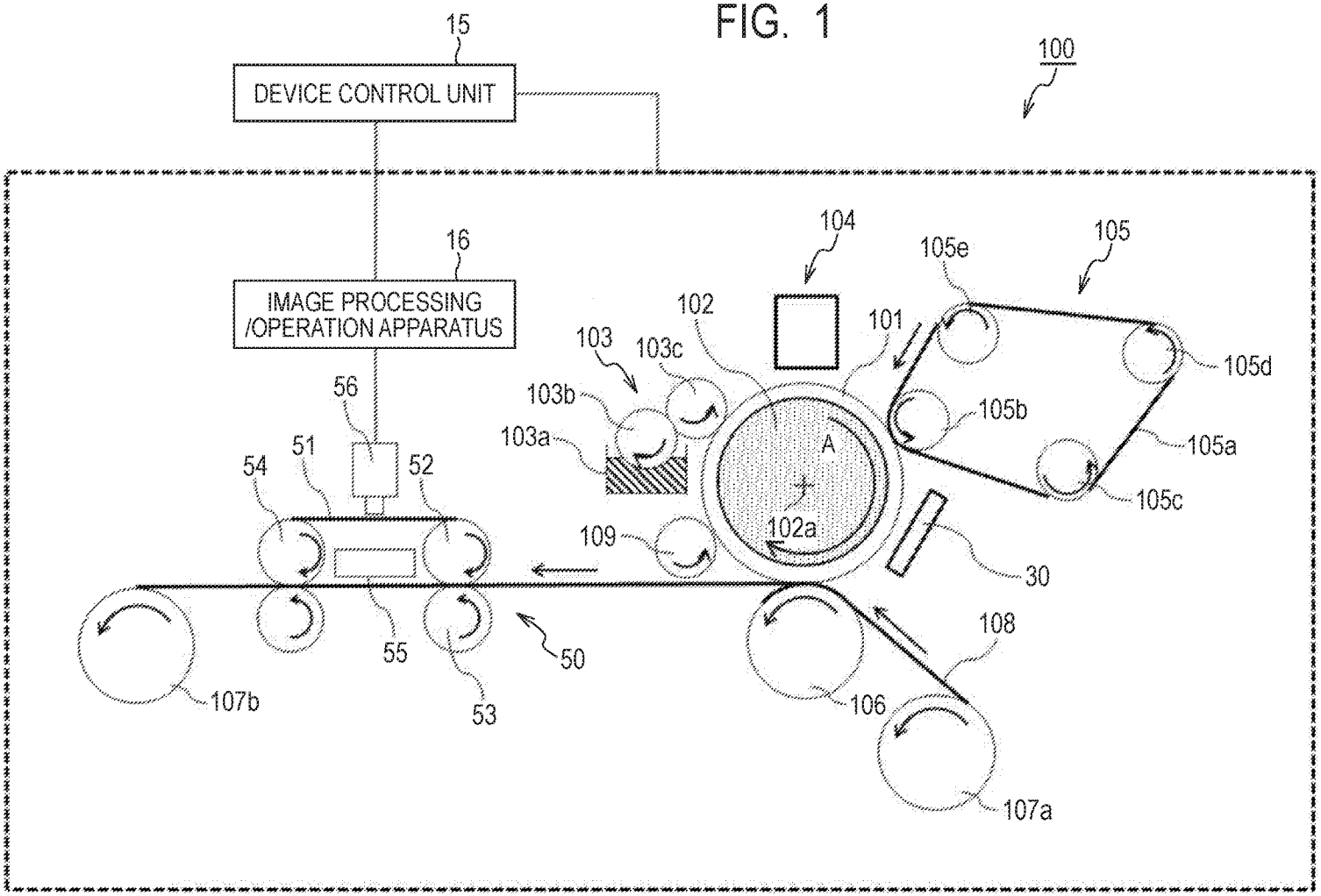
FIG. 1 is a schematic diagram showing an example of a configuration of a transfer type ink jet recording apparatus according to an embodiment of the present invention.

Preferred embodiments of the present invention will now be described in detail in accordance with the accompanying drawings.

According to studies of the inventors of the present invention, we have found that a problem may arise at the time of fixing by a heating and pressing unit after controlling the remaining amount of ink-derived water after drying as disclosed in Japanese Patent Application Laid-Open No. 2010-5815. In other words, when the removal of the solvent other than the ink-derived water is insufficient, gloss may temporarily increase, but the gloss may decrease as time passes. That is, according to the studies of the inventors, we have found that when the removal of a liquid component in an image (ink image) is insufficient, high glossiness can be obtained immediately after fixing by the heating and pressing unit, but the gloss decreases as time passes, such that it is difficult to obtain an image with high gloss. On the other hand, if the removal of a solvent other than the ink-derived water is excessive, a decrease in gloss as time passes hardly occurs, but there is a problem in that an image having high gloss is hardly obtained.

Hereinafter, the present invention will be described in detail with reference to preferable embodiments.

First, an outline of a transfer type ink jet recording apparatus for forming an image using a transfer body will be described. First, a roller type coating apparatus brings ink into contact with a transfer body to aggregate a coloring material component (pigment) or a resin (resin particles) in the ink to coat a reaction liquid containing an ink viscosity-increasing component that can increase the viscosity of the ink. Next, if the transfer body reaches a position where the ink is applied by an ink jet recording head, the ink is discharged from the ink jet recording head to the transfer body, and reacts with the reaction liquid previously coated on the transfer body to form an ink aggregated layer (referred to as ink image or simply "image") on the transfer body. Further, if the transfer body reaches a position where it comes into contact with a liquid removing unit (also referred to as a liquid absorbing unit), at least a part of the liquid component contained in the ink image is absorbed into the liquid removing unit. Next, if the transfer body reaches a position where it is heated by a heating and drying apparatus, the liquid component, which is not absorbed into the liquid removing unit, is removed by heating and drying. Since the transfer body reaches a transfer part including a pressing member for transferring, the ink image is transferred to a recording medium.

Subsequently, if the recording medium reaches a position of a fixing unit (also referred to as a heating and pressing unit), the ink image is pressed and heated in a state in which a fixing substrate (also referred to as a fixing member) comes in contact with the ink image to fix the ink image on the recording medium and apply gloss to a surface of the ink image. Next, a surface of the fixing substrate after the fixing of the ink image on the recording medium is observed by a liquid adhesion detection unit to perform an image analysis or the like. Next, a liquid adhesion determination unit determines whether a liquid adheres to the fixing substrate based on a result of the image analysis on the surface of the fixing substrate which is obtained by the liquid adhesion detection unit. After the operation is repeated by changing conditions, a liquid removing condition changing unit changes the setting of the liquid removing conditions from the ink image based on the determination result on the liquid adhesion. In this way, it is possible to appropriately change the setting of the liquid removal amount and provide an image with high gloss and with no change in gloss even after the passage of time. In this specification, the term "recording medium" refers not only to paper used for general printing, but also extensively, cloth, plastics, films and other print media and recording media. It should be noted that there is a "discharge receiving medium" or an "ink receiving medium" that includes a transfer body in the case of a transfer type in which an image is formed on a "transfer body or the like" and is transferred onto a recording medium and a recording medium in the case in which the image is directly formed on the recording medium. In addition, a first image (a first ink image) is an ink image in which a liquid is not removed not by being subjected to the liquid absorption treatment, and a second image (a second ink image) is an ink image in which a content of a liquid component is reduced by being subjected to the liquid absorption treatment.

In the ink jet recording apparatus of the present invention, an image forming unit is not particularly limited as long as it can form a first image including a first liquid and a coloring material on a discharge receiving medium. Preferably, the image forming unit includes 1) a device which applies a first liquid composition containing a first liquid or a second liquid onto a discharge receiving medium, 2) a device which applies a second liquid composition including a first liquid or a second liquid and a coloring material onto a discharge receiving medium. The image forming unit forms a first image as a mixture of the first and second liquid compositions.

In general, the second liquid composition is an ink containing a coloring material, and a device which applies the second liquid composition onto the discharge receiving medium is an ink jet recording device. In addition, the first liquid composition includes a component (referred to as an ink viscosity-increasing component) which chemically or physically reacts with the second liquid composition to more increase viscosity of the mixture of the first and second liquid compositions than that of each of the first and second liquid compositions. At least one of the first and second liquid compositions contains a first liquid.

Here, the first liquid contains a liquid with low volatility at normal temperature (room temperature), particularly water. The second liquid is a liquid other than the first liquid, and is not limited as to whether the volatility is high or low, but is preferably a liquid having higher volatility than the first liquid. Hereinafter, the first liquid composition is referred to as a "reaction liquid", and the device which applies the first liquid composition onto the discharge receiving medium is referred to as a "reaction liquid applying device". Also, the second liquid composition is referred to as "ink", and a device which applies the second liquid composition onto the discharge receiving medium is referred to as "ink applying device".

<Reaction Liquid Applying Device>

As a reaction liquid applying device, various devices which are known conventionally can be suitably used as long as they can apply a reaction liquid onto a discharge receiving medium. Specific examples of the apparatus may include a gravure offset roller, an ink jet head, a die coating device (die coater), a blade coating device (blade coater) or the like. The application of the reaction liquid by the reaction liquid applying device may be performed before the application of the ink or after the application of the ink as long as the reaction liquid can mix (react) with the ink on the discharge receiving medium. Preferably, the reaction liquid is applied before the application of the ink. By applying the reaction liquid before the application of the ink, bleeding in which inks applied adjacent to each other are mixed with each other or beading in which the previously landed ink is attracted to the subsequently landed ink may be suppressed during the image recording by an ink jet system.

<Reaction Liquid>

Hereinafter, each component constituting the reaction liquid which is applied to the present embodiment will be described in detail.

(Reactant)

The reaction liquid comes into contact with the ink to aggregate components (resin, self-dispersible pigment or the like) having an anionic group in the ink, and contains a reactant (referred to as an ink viscosity-increasing component). Examples of the reactant may include polyvalent metal ions, cationic components such as cationic resins, organic acids or the like.

Examples of the polyvalent metal ions may include divalent metal ions such as $Ca^{2+}$, $Cu^{2+}$, $Ni^{2+}$, $Mg^{2+}$, $Sr^{2+}$, $Ba^{2+}$ and $Zn^{2+}$ or trivalent metal ions such as $Fe^{3+}$, $Cr^{3+}$, $Y^{3+}$ and $Al^{3+}$. In order to contain the polyvalent metal ions in the reaction liquid, a polyvalent metal salt (which may be a hydrate) formed by combining the polyvalent metal ions with an anion can be used. Examples of the anion may include inorganic anions such as $Cl^-$, $Br^-$, $I^-$, $ClO^-$, $ClO_2^-$, $ClO_3^-$, $ClO_4^-$, $NO_2^-$, $N_3^-$, $SO_4^{2-}$, $CO_3^{2-}$, $HCO_3^-$, $PO_4^{3-}$, $HPO_4^{2-}$ and $H_2PO_4^-$, organic anions such as $HCOO^-$, $(COO^-)_2$, COOH $(COO^-)$, $CH_3COO^-$, $C_2H_4(CO^-)_2$, $C_6H_5COO^-$, $C_6H_4(COO^-)_2$ and $CH_3SO_3^-$. When the polyvalent metal ion is used as the reactant, the content (% by mass) in terms of polyvalent metal salt in the reaction liquid is 1.00% by mass or more to 20.00% by mass or less with respect to the total mass of the reaction liquid.

The reaction liquid containing an organic acid has buffering capacity in an acidic region (pH less than 7.0, preferably pH 2.0 to 5.0), so the anionic group of the component present in the ink is converted into an acid form and aggregated. Examples of the organic acid may include monocarboxylic acids such as formic acid, acetic acid, propionic acid, butyric acid, benzoic acid, glycolic acid, lactic acid, salicylic acid, pyrrolecarboxylic acid, furancarboxylic acid, picolinic acid, nicotinic acid, thiophenecarboxylic acid, levulinic acid and coumaric acid and salts thereof; dicarboxylic acids such as oxalic acid, malonic acid, succinic acid, glutaric acid, adipic acid, maleic acid, fumaric acid, itaconic acid, sebacic acid, phthalic acid, malic acid and tartaric acid and salts thereof or hydrogen salt thereof; tricarboxylic acids such as citric acid and trimellitic acid and salts and hydrogen salts thereof; tetracarboxylic acids such as pyromellitic acid and salts and hydrogen salts thereof and the like. It is preferable that the content (% by mass) of the organic acid in the reaction liquid is 1.00% by mass or more to 50.00% by mass or less.

Examples of the cationic resin may include resins having a structure of primary to tertiary amines, a resin having a structure of a quaternary ammonium salt and the like. Specific examples of the cationic resin may include resins having a structure of vinylamine, allylamine, vinylimidazole, vinylpyridine, dimethylaminoethyl methacrylate, ethyleneimine, guanidine and the like. In order to increase the solubility in the reaction liquid, it is also possible to use the cationic resin in combination with an acidic compound or to quaternize the cationic resin. When the cationic resin is used as the reactant, the content (% by mass) of the cationic resin in the reaction liquid is preferably 1.00% by mass or more to 10.00% by mass or less with respect to the total mass of the reaction liquid.

(Components Other than Reactant)

As the components other than the reactant, components similar to an aqueous medium, other additives and the like which are mentioned as components which can be used for the ink described later can be used.

In the present invention, the increase in viscosity of an ink is also referred to as "viscously thickening ink". As the ink viscosity-increasing component, known components such as polyvalent metal ions, organic acids, cationic polymers, porous fine particles or the like can be used. Among those, in particular, the polyvalent metal ions and the organic acids are preferable. In addition, it is also preferable to contain plural types of ink viscosity-increasing components. The content of the ink viscosity-increasing component in the reaction liquid is preferably 5% by mass or more with respect to the total mass of the reaction liquid.

<Ink Applying Device>

An ink jet head is used as an ink applying device (ink applying unit) which applies an ink. As the ink jet head, there may be, for example, a type of discharging ink by forming bubbles which causes film boiling in ink by an electrothermal transducer, a type of discharging ink by an electro-mechanical transducer, a type of discharging ink using static electricity or the like. In the present embodiment, the known ink jet head can be used. Among those, in particular, from the viewpoint of high speed and high density printing, the electrothermal transducer is preferably used. Drawing receives an image signal and applies a necessary ink amount to each position.

Although an ink applying amount can be expressed by a concentration value, an ink thickness or the like of image data, in the present invention, an average value which is obtained by multiplying the applied number of ink dots by a mass of each ink dot and dividing the multiplied value by a printing area is defined as the ink application amount ($g/m^2$). It should be noted that the maximum ink applying amount in the image region means the amount of ink applied at an area of at least 5 $mm^2$ or more in the region used as the information of the discharge receiving medium from the viewpoint of removing the liquid component in the ink.

The ink jet recording apparatus of the present embodiment may have a plurality of ink jet heads to apply the ink of each color onto the discharge receiving medium. For example, when each color image is formed by using yellow ink, magenta ink, cyan ink and black ink, the ink jet recording apparatus has four ink jet heads which discharge four kinds of inks, respectively, onto the discharge receiving medium. These ink jet heads are arranged to line up in an X direction.

In addition, the ink applying device may also include an ink jet head which discharges a substantially transparent ink (clear ink) which does not contain a coloring material at all or contains a coloring material in a very low percentage. The clear ink can be used to form an ink image together with the reaction liquid and the color ink. For example, it is possible to use the clear ink for improving glossiness of an image. It is preferable to appropriately adjust the resin components to be blended and further control the discharge position of the clear ink so that the image after the transfer presents a glossy feeling. Since it is preferable that the clear ink is located closer to a surface layer side than the color ink in a final recorded product, the transfer body type recording apparatus is configured to apply the clear ink onto the transfer body prior to applying the color ink. Therefore, in the moving direction of the transfer body facing the ink applying device (ink image forming unit) 104, the ink jet head for clear ink can be arranged above the ink jet head for color ink.

In addition, the clear ink can be used not only to improve the glossiness of the image but also to improve the transferability of the image from the transfer body to the recording medium. For example, it is possible to use the clear ink as a transferability improving liquid applied onto the transfer body by including a large amount of components exhibiting stickiness more than that of the color ink and applying the components to the color ink. For example, the ink jet head for the clear ink for improving transferability is arranged under the ink jet head for color ink in the moving direction of the transfer body 1 facing the ink applying device 104. After the color ink is applied onto the transfer body, the clear ink is applied onto the transfer body to which the color ink is applied, so the clear ink exists on the outermost surface of the ink image. In transferring the ink image from the transfer part to the recording medium, the clear ink on the surface of the ink image adheres to the recording medium 108 with a certain degree of adhesive force, so that the ink image from which the liquid is removed easily moves to the recording medium 108.

<Ink>

Hereinafter, each component constituting the ink which is applied to the present embodiment will be described in detail.

(Coloring Material)

A pigment or a dye can be used as the coloring material. The content of the coloring material in the ink is preferably 0.5% by mass or more to 15.0% by mass or less, more preferably 1.0% by mass or more to 10.0% by mass or less with respect to the total mass of the ink.

Specific examples of the pigment may include inorganic pigments such as carbon black and titanium oxide; organic pigments such as azo, phthalocyanine, quinacridone, isoindolinone, imidazolone, diketopyrrolopyrroles and dioxazine or the like.

As the dispersion system of the pigment, a resin-dispersed pigment using a resin as a dispersant, a self-dispersible pigment in which a hydrophilic group is bonded to a particle surface of the pigment or the like can be used. In addition, a resin-bonded pigment in which an organic group containing a resin is chemically bonded to the particle surface of the pigment, a microcapsule pigment in which the particle surface of the pigment is covered with a resin or the like can be used.

As the resin dispersant for dispersing the pigment in the aqueous medium, it is preferable to use those capable of dispersing the pigment in the aqueous medium by the action of the anionic group. As the resin dispersant, a resin to be described later can be preferably used, and a water-soluble resin can be more preferably used. The content (% by mass) of the pigment is preferably 0.3 times or more to 10.0 times or less with respect to the content of the resin dispersant in terms of a mass ratio (pigment/resin dispersant).

As the self-dispersible pigment, a pigment in which anionic groups such as a carboxylic acid group, a sulfonic acid group and a phosphonic acid group is bonded directly to the particle surface of the pigment or bonded to the particle surface of the pigment through another atomic group (—R—) can be used. The anionic group may be either an acid form or a salt form. In the case of the salt form, the anionic group may be either a state in which it is partially dissociated or a state in which it is completely dissociated. Examples of cation which is a counter ion in the case where the anionic group is the salt form may include alkali metal cation; ammonium; organic ammonium and the like. In addition, specific examples of other atomic groups (—R—) may include a linear or branched alkylene group having 1 to 12 carbon atoms, arylene groups such as a phenylene group and a naphthylene group, a carbonyl group, an imino group, an amide group, a sulfonyl group, an ester group and an ether group and the like. In addition, other atomic groups may be groups which are formed by combining these groups.

As the dye, a dye having an anionic group is preferably used. Specific examples of the dye may include dyes such as azo, triphenylmethane, (aza) phthalocyanine, xanthene and anthrapyridone.

(Resin)

The ink may contain the resin. The content (% by mass) of the resin in the ink is preferably 0.1% by mass or more to 20.0% by mass or less with respect to the total mass of the ink, and more preferably 0.5% by mass or more to 15.0% by mass or less.

The resin can be added to the ink for the following reasons: (i) to stabilize the dispersion state of the pigment, that is, as the above-mentioned resin dispersant or its assistance, (ii) to improve various properties of the recorded image or the like. Examples of the form of the resin may include a block copolymer, a random copolymer, a graft copolymer, combinations thereof and the like. In addition, the resin may be dissolved in an aqueous medium as a water-soluble resin, or may be dispersed in an aqueous medium as resin particles. The resin particles do not have to contain the coloring material.

In the present invention, the fact that the resin is water-soluble means that when the resin is neutralized with alkali equivalent to an acid value, particles whose diameter is measured by a dynamic light scattering method are not formed. It can be determined whether or not the resin is water-soluble by the following method. First, a liquid (resin solid content: 10% by mass), which contains the resin neutralized with the alkali (sodium hydroxide, potassium hydroxide or the like) equivalent to the acid value, is prepared. Next, the prepared liquid is diluted with pure water by 10 times (volume basis) to prepare a sample solution. When the particle diameter of the resin in the sample solution is measured by the dynamic light scattering method or when particles having a particle diameter are not measured, it can be determined that the resin is water-soluble. The measurement conditions may be set as follows: For example, SetZero: 30 seconds, measurement number: 3 times, measurement time: 180 seconds. As a particle size distribution measuring device, a particle size analyzer (for example, trade name "UPA-EX 150" manufactured by Nikkiso Co., Ltd.) or the like by the dynamic light scattering method can be used. It goes without saying that the particle size distribution measuring device to be used, the measurement conditions or the like are not limited thereto.

In the case of the water-soluble resin, the acid value of the resin is preferably 100 mg KOH/g or more to 250 mg KOH/g or less, and in the case of the resin particles, the acid value of the resin is preferably 5 mg KOH/g or more to 100 mg KOH/g or less. In the case of the water-soluble resin, a weight average molecular weight of the resin is preferably 3,000 or more to 15,000 or less, and in the case of the resin particles, a weight average molecular weight of the resin is preferably 1,000 or more to 2,000,000 or less. A volume average particle diameter measured by the dynamic light scattering method (the same as the above conditions) of the resin particles preferably is 100 nm or more to 500 nm or less.

Examples of the resin may include an acrylic resin, a urethane-based resin, an olefin-based resin and the like. Among them, the acrylic resin or the urethane-based resin is preferable.

As the acrylic resin, one which has a hydrophilic unit and a hydrophobic unit as a constitutional unit is preferably used. Among them, a resin having a hydrophilic unit derived from (meth) acrylic acid and a hydrophobic unit derived from at least one of a monomer having an aromatic ring and a (meth) acrylic acid ester based monomer is preferable. In particular, a resin having a hydrophilic unit derived from (meth) acrylic acid and a hydrophobic unit derived from at least one monomer of styrene and α-methylstyrene is preferable. Since these resins easily interact with the pigment, they can be suitably used as a resin dispersant for dispersing the pigment.

The hydrophilic unit is a unit having a hydrophilic group such as an anionic group. The hydrophilic unit can be formed by polymerizing, for example, a hydrophilic monomer having a hydrophilic group. Specific examples of the hydrophilic monomer having the hydrophilic group may include acidic monomers having carboxylic acid groups such as (meth) acrylic acid, itaconic acid, maleic acid, fumaric acid, anionic monomers such as anhydrides and salts of these acidic monomers and the like. Examples of the cation constituting the salt of the acidic monomer may include ions such as lithium, sodium, potassium, ammonium, organic ammonium and the like. The hydrophobic unit is a unit which does not have a hydrophilic group such as an anionic group. The hydrophobic unit can be formed by polymerizing, for example, a hydrophobic monomer which does not have a hydrophilic group such as an anionic group. Specific examples of the hydrophobic monomer may include monomers having aromatic rings such as styrene, α-methylstyrene and benzyl (meth) acrylate, (meth) acrylate ester monomer such as methyl (meth) acrylate, butyl (meth) acrylate and 2-ethylhexyl (meth) acrylate and the like.

The urethane-based resin can be obtained, for example, by reacting polyisocyanate with polyol. In addition, the urethane-based resin can be obtained by the additional reaction of the chain extender. Examples of the olefin-based resin may include polyethylene, polypropylene and the like.

(Aqueous Medium)

The ink can contain water or an aqueous medium which is a mixed solvent of water and a water-soluble organic solvent. It is preferable to use deionized water or ion-exchanged water as the water. The content (% by mass) of the water in the aqueous ink is preferably 50.0% by mass or more to 95.0% by mass or less with respect to the total mass of the ink. In addition, the content (% by mass) of the water-soluble organic solvent in the aqueous ink is preferably 3.0% by mass or more to 50.0% by mass or less with respect to the total mass of the ink. As the water-soluble organic solvent, any of alcohols, (poly) alkylene glycols, glycol ethers, nitrogen-containing compounds, sulfur-containing compounds and the like which can be used for the ink for the ink jet can be used.

(Other Additives)

In addition to the above components, if necessary, the ink may contain various additives such as an antifoaming agent, a surfactant, a pH adjusting agent, a viscosity adjusting agent, a rust-preventive agent, an antiseptic agent, a mildewproofing agent, an antioxidant and a reduction inhibitor.

<Auxiliary Liquid>

It is preferable that the same auxiliary liquid applying device (not shown) as the ink applying device applies an auxiliary liquid containing a resin onto the reaction liquid and the ink which is applied on the transfer body. It is possible to improve the transferability by heating and transferring the first image at a glass transition point or a softening point or more of the resin. This auxiliary liquid corresponds to the above-mentioned clear ink for improving the transferability.

In addition, as components contained in the auxiliary liquid except that the auxiliary liquid does not contain the coloring material, the same components as those of the ink can be used.

<Liquid Absorbing Member>

In the present invention, at least a part of the first liquid from the first image is absorbed by coming into contact with the liquid absorbing member having the porous body to reduce the liquid amount in the first image. A contact surface with the first image of the liquid absorbing member is defined as a first surface, and the porous body is disposed on the first surface. It is preferable that the liquid absorbing member having such a porous body has a shape in which it moves in conjunction with the movement of the discharge receiving medium and is circulated while coming into contact with the first image and then re-contact with another first image at a predetermined cycle to be able to absorb a liquid. Examples of the shape may include an endless belt shape, a drum shape or the like.

(Porous Body)

It is preferable that the porous body of the liquid absorbing member according to the present invention uses an object having an average pore diameter on a first surface side smaller than that on a second surface side opposite to the first surface. To suppress the adhesion of the ink coloring material onto the porous body, it is preferable that the pore diameter is small, and the average pore diameter of the porous body on the first surface side contacting at least the image is 10 μm or less. In the present invention, the average pore diameter exhibits the average diameters on the first surface or the second surface, and can be measured by known methods such as a mercury press-in method, a nitrogen adsorption method and an SEM image observation.

In addition, it is preferable to reduce the thickness of the porous body so as to obtain uniformly high air permeability. The air permeability can be indicated by the Gurley value defined in JIS P8117, and the Gurley value is preferably 10 seconds or less.

However, if the porous body is made thin, there are cases where it is not possible to sufficiently secure the capacity necessary for absorbing the liquid component, so it is possible to make the porous body into a multilayer structure. Further, in the liquid absorbing member, the layer in contact with the first image may be the porous body, and the layer not in contact with the first image may be the porous body.

Next, the embodiment in which the porous body is made into the multilayer structure will be described. Here, the side contacting the first image will be described as the first layer, and the layer laminated on the surface opposite to the contact surface with the first image of the first layer will be described as the second layer. Further, the structure of the multilayer is sequentially expressed in the order of lamination from the first layer. In the specification, the first layer may be referred to as an "absorbing layer" and a layer subsequent to the second layer may be referred to as a "support layer". In the present invention, the material of the first layer is not particularly limited, and any of a hydrophilic material having a contact angle with respect to water of less than 90° and a water-repellent material having a contact angle of 90° or more can be used.

The hydrophilic material is preferably selected from a single material such as cellulose and polyacrylamide, a composite material thereof or the like. In addition, it is also possible to use the following water-repellent material whose surface is subjected to the hydrophilic treatment. Examples of the hydrophilic treatment may include a sputter etching method, a method such as irradiation with radiation, $H_2O$ ion irradiation and excimer (ultraviolet) laser light irradiation.

In the case of the hydrophilic material, it is more preferable that the contact angle with water is 60° or less. In the case of the hydrophilic material, there is an effect of sucking up liquid, particularly water by a capillary force.

On the other hand, in view of suppressing the coloring material adhesion and enhancing the cleaning performance, it is preferable that the material of the first layer is a water-repellent material having low surface free energy, particularly, a fluororesin. Specific examples of the fluororesin may include polytetrafluoroethylene (PTFE), polychlorotrifluoroethylene (PCTFE), polyvinylidene fluoride (PVDF), polyvinyl fluoride (PVF), perfluoroalkoxy fluorine resin (PFA), tetrafluoroethylene.hexafluoropropylene copolymers (FEP), ethylene.tetrafluoroethylene copolymer (ETFE), ethylene.chlorotrifluoroethylene copolymer (ECTFE) or the like.

One or two more kinds of resins can be used if necessary, and the configuration in which a plurality of films are laminated in the first layer may be adopted. In the case of the water-repellent material, there is almost no effect of sucking up the liquid by the capillary force, and it takes time to suck up the liquid for the first time at the time of contacting the image. Therefore, it is preferable that the liquid having the contact angle with the first layer of less than 90° is impregnated into the first layer. As compared to the first liquid and any second liquid in the first image, the liquid which is impregnated into the first layer may be referred to as a third liquid. The third liquid can be impregnated into the first layer by being coated from the first surface of the liquid absorbing member. The third liquid may be preferably prepared by mixing a surfactant or a liquid having a low contact angle with the first layer with the first liquid (water).

In the present invention, a film thickness of the first layer is preferably 50 μm or less. The film thickness of the first layer is more preferably 30 μm or less. In the embodiment of the present invention, the film thickness is obtained by measuring a film thickness of arbitrary 10 points by a linear advance micrometer OMV_25 (manufactured by Mitutoyo Corporation) and calculating the average value thereof.

The first layer can be produced by the known method for producing a thin film porous membrane. For example, the first layer can be obtained by making a resin material into a sheet material by a method such as extrusion molding and then stretching the sheet material to a predetermined thickness. In addition, the first layer can be obtained as a porous membrane by adding a plasticizer such as paraffin to a material at the time of the extrusion molding and removing the plasticizer by heating or the like at the time of stretching. The pore diameter can be controlled by appropriately adjusting the amount of plasticizer to be added, a draw ratio and the like.

[Second Layer]

In the present invention, the second layer is preferably a layer having air permeability. Such a layer may be a nonwoven fabric of resin fiber or a woven fabric. Although the material of the second layer is not particularly limited, it is preferable that the material of the second layer is a material having the same or lower contact angle with the first liquid as compared to the first layer so that the liquid absorbed into the first layer side does not reflow. Specifically, the material of the second layer may preferably selected from a single material such as polyolefin (polyethylene (PE), polypropylene (PP) or the like), polyurethane, polyamide such as nylon, polyester (polyethylene terephthalate (PET) or the like) and polysulfone (PSF) or a composite material thereof. In addition, the second layer is preferably a layer having a pore diameter larger than that of the first layer.

[Third Layer]

In the present invention, the porous body having the multilayer structure may have a structure of three or more layers, but the structure of the porous body is not limited thereto. From the viewpoint of rigidity, a nonwoven fabric is preferably used for layers after a $3^{rd}$ layer (also referred to as a third layer). The material, the same material as the second layer is used.

[Other Materials]

The liquid absorbing member may have a reinforcing member for reinforcing the side surface of the liquid absorbing member, in addition to the porous body having the above-described laminated structure. In addition, the liquid absorbing method may have a joining member as a belt-shaped member for joining longitudinal end portions of a long sheet-shaped porous body. As such a material, a non-porous tape material or the like can be used, which may be arranged at a position or a period at which it is not in contact with an image.

[Method for Producing Porous Body]

The method for forming a porous body by laminating a first layer and a second layer is not particularly limited. The first layer and the second layer may overlap each other, and may also adhere to each other by a method such as lamination by adhesive agent or lamination by heating. From the viewpoint of the air permeability, the lamination by heating is preferable in the present invention. In addition, for example, the first layer or the second layer is partially melted by heating to be adhesively laminated to each other. Alternatively, the first layer and the second layer may be adhesively laminated to each other by interposing a fusing material such as hot melt powder between the first layer and the second layer and heating the fusing material. In the case of laminating the third layer or more, these layers may be laminated at once or laminated in order, and the laminating order is appropriately selected.

In the heating process upon producing the porous body, a lamination method for heating a porous body while holding the porous body between heated rollers and pressurizing the porous body with the rollers is preferable.

Hereinafter, specific embodiments of the ink jet recording apparatus of the present invention will be described.

There are two types of ink jet recording apparatuses of the present invention: An ink jet recording apparatus which forms a first image on a transfer body as a discharge receiving medium and transfers a second image onto a recording medium after a first liquid is absorbed by a liquid absorbing member and an ink jet recording apparatus which forms a first image on a recording medium as a discharge receiving medium. In the present invention, hereinafter, for convenience, the former ink jet recording apparatus is referred to as a transfer type ink jet recording apparatus, and the latter ink jet recording apparatus is referred to as a direct drawing type ink jet recording apparatus.

Hereinafter, the ink jet recording apparatuses each will be described.

(Transfer Type Ink Jet Recording Apparatus)

In a transfer type ink jet recording apparatus, a discharge receiving medium is a transfer body for temporarily holding a first image and a second image absorbing a first liquid from the first image. In addition, the transfer type ink jet recording apparatus includes a transfer part (transfer unit) which includes a pressing member for transferring which transfers the second image onto a recording medium on which an image is to be formed.

FIG. 1 is a schematic diagram showing an example of a schematic configuration of a transfer type ink jet recording apparatus according to the present embodiment.

As shown in FIG. 1, a transfer type ink jet recording apparatus 100 of the present invention includes a transfer unit that includes a transfer body 101, a reaction liquid applying device 103, an ink applying device 104, a liquid absorbing device 105 and a pressing member 106 for transferring. The transfer body 101 is supported by a support member 102. The reaction liquid applying device 103 applies a reaction liquid onto the transfer body 101. The ink applying device (ink image forming unit) 104 applies ink onto the transfer body 101 to which a reaction liquid is applied to form a first image (ink image) on the transfer body. The liquid absorbing device (liquid removing unit) 105 absorbs a liquid component in the ink image on the transfer body. A pressing member (transfer unit) 106 transfers the second image on the transfer body, from which the liquid component is removed, onto a recording medium 108 such as paper. In addition, if necessary, the transfer type ink jet recording apparatus 100 includes a cleaning member (cleaning unit) 109 for transfer body which cleans a surface of the transfer body 101 to which the ink is transferred. This makes it possible to clean impurities derived from the reaction liquid or the ink adhering to the fixing substrate.

The support member 102 rotates in a direction of arrow A in FIG. 1 about a rotating shaft 102*a*. The transfer body 101 moves by the rotation of the support member 102. The reaction liquid by the reaction liquid applying device 103 and the ink by the ink applying device 104 are sequentially applied onto the moving transfer body 101, so the first image is formed on the transfer body 101. The first image formed on the transfer body 101 moves to a position, where the first image comes into contact with the liquid absorbing member 105*a* of the liquid absorbing device 105, by the movement of the transfer body 101.

The transfer body 101 and the liquid absorbing device 105 move in synchronization with each other, and the image subjects to a state in contact with the liquid absorbing member 105*a*. In the meantime, the liquid absorbing member 105*a* removes the liquid component from the image.

The image subjects to the state in which it comes into contact with the liquid absorbing member 105*a*, so the liquid component is substantially removed. At this time, it is particularly preferable to make the image and the liquid absorbing member 105*a* into a pressure contact state in which they come into contact with each other with a predetermined pressing force, from the viewpoint of effectively functioning the liquid absorbing member 105*a* in the present device configuration.

The removal of the liquid component can be expressed from a different point of view as concentrating the ink constituting the image (first image) formed on the transfer body. Concentrating the ink means that the proportion of the solid content contained in the ink, such as coloring material and resin, with respect to the liquid component contained in the ink increases owing to reduction in the liquid component.

Then, the second image from which the liquid component is removed moves to the transfer part which comes into contact with the recording medium 108 by the movement of the transfer body 101, and pressure-contacts the recording medium 108 conveyed to the transfer part by a conveyance device 107 for recording medium, thereby forming an image on the recording medium 108. The image which is transferred onto the recording medium 108 is a reverse image of the second image, which is referred to as a third image (a third ink image).

Since the image is formed by applying the reaction liquid onto the transfer body and then applying the ink, the reaction liquid remains in a non-image region without reacting with the ink. In the present apparatus, the liquid absorbing member 105*a* contacts (pressure contacts) not only the image but also the unreacted reaction liquid to remove even the liquid component of the reaction liquid.

However, the removal of the liquid component from the image is expressed and described above, which is not limited to the removal of the liquid component from the image alone but means that at least the liquid component is removed from the image on the transfer body.

It should be noted that the liquid component is not particularly limited as long as it does not have a certain shape, has fluidity, and has substantially a constant volume. For example, the water, the organic solvents and the like which are contained in the ink or the reaction liquid can be regarded as the liquid component.

Each component of the transfer type ink jet recording apparatus of the present embodiment will be described below.

<Transfer Body>

The transfer body 101 has a surface layer including an image forming surface. As a member of the surface layer, various materials such as resin and ceramic can be appropriately used, but a material having high compressive elastic modulus is preferable in terms of durability or the like. Specific examples of the material may include an acrylic resin, an acrylic silicone resin, a fluorine-containing resin, a condensate obtained by condensing a hydrolysable organosilicon compound or the like. Surface treatment may be performed to improve wettability, transferability or the like of the reaction liquid. Examples of the surface treatment may include frame treatment, corona treatment, plasma treatment, polishing treatment, roughening treatment, active energy ray irradiation treatment, ozone treatment, surfactant treatment, silane coupling treatment or the like. The plurality of combinations thereof may also be used. In addition, arbitrary surface shapes may be provided on the surface layer.

Further, it is preferable that the transfer body 101 has a compressible layer which has a function of absorbing a pressure fluctuation. By providing the compressible layer, the compressible layer can absorb deformation, disperse the pressure fluctuation in response to a local pressure fluctuation, and maintain good transferability even at the time of high speed printing. Examples of the member of the compressible layer may include acrylonitrile-butadiene rubber, acrylic rubber, chloroprene rubber, urethane rubber, silicone rubber or the like. It is preferable that a porous material is formed by blending a predetermined amount of vulcanizing agent, a vulcanization accelerator or the like at the time of molding the rubber material, and further blending fillers such as a foaming agent, hollow fine particles and sodium chloride if necessary. As a result, a bubble part is compressed with its volume change in response to various pressure fluctuations, so a deformation in a direction other than a compressible direction is small and more stable transferability and durability can be obtained. As the porous rubber materials, there are materials having a continuous pore structure in which each pore is continuous with each other and an independent pore structure in which each pore is independent from each other. In the present invention, any of the structures may be used, and these structures may be used in combination.

Further, it is preferable that the transfer body 101 has an elastic layer between the surface layer and the compressible layer. As the member of the elastic layer, various materials such as resin and ceramics can be appropriately used. In terms of the processing characteristics or the like, various elastomer materials and rubber materials are preferably used. Specific examples may include fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, ethylene/propylene/butadiene copolymer, nitrile butadiene rubber or the like. The silicone rubber, the fluorosilicone rubber, and the phenyl silicone rubber are particularly preferable in dimensional stability and durability because they have small compression set. In addition, it is preferable that the change in elastic modulus due to temperature is small, which is also preferable in terms of transferability.

Various adhesives or double-sided tapes may be used for fixing and holding the respective layers (surface layer, elastic layer, compressible layer) configuring the transfer body 101. In addition, a reinforcing layer having a high compression elastic modulus may be provided to suppress lateral extension or maintain stiffness when being mounted in the apparatus. In addition, woven fabric may be used as a reinforcing layer. The transfer body 101 may be produced by arbitrarily combining the respective layers by the materials.

The size of the transfer body 101 can be freely selected according to the size of the target print image. The shape of the transfer body 101 is not particularly limited, and specific examples of the shape of the transfer body may include a sheet shape, a roller shape, a belt shape, an endless web form or the like.

<Support Member>

The transfer body 101 is supported on the support member 102. As a method for supporting a transfer body, various adhesives or double-sided tapes may be used. Alternatively, a mounting member formed of metal, ceramic, resin or the like is attached to the transfer body, so the transfer body may be supported on the support member 102 by the mounting member.

The support member 102 needs to have a certain level of structural strength from the viewpoint of conveyance accuracy and durability of the support member 102. As the material of the support member 102, metal, ceramic, resin or the like are preferably used. Among those, in particular, to improve control responsiveness by reducing an inertia during the operation in addition to improve rigidity or dimensional accuracy which can withstand the pressing during the transfer, aluminum, iron, stainless steel, acetal resin, epoxy resin, polyimide, polyethylene, polyethylene terephthalate, nylon, polyurethane, silica ceramics, alumina ceramics or the like are preferably used. In addition, the combinations thereof are preferably used.

<Reaction Liquid Applying Device>

The ink jet recording apparatus of the present embodiment has the reaction liquid applying device 103 which applies the reaction liquid to the transfer body 101. The reaction liquid comes into contact with the ink to lower flowability of ink and/or a part of ink compositions on the discharge receiving medium, thereby suppressing the bleeding or the beading at the time of forming the image by the ink. Specifically, the reactant (also referred to as ink viscosity-increasing component) contained in the reaction liquid comes into contact with the coloring material, the resin or the like which is a part of the compositions constituting the ink to react chemically reaction or be absorbed physically. By doing so, the increase in the viscosity of the entire ink or the local increase in the viscosity of the ink due to an aggregate of a part of components constituting the ink such as the coloring material occurs to lower the flowability of ink and/or a part of ink compositions. A case of a gravure offset roller in which the reaction liquid applying device 103 shown in FIG. 1 includes a reaction liquid container 103*a* which contains the reaction liquid, and reaction liquid applying members 103*b* and 103*c* which apply the reaction liquid in the reaction liquid container 103*a* onto the transfer body 101 is shown.

<Ink Applying Device>

The ink jet recording apparatus of the present embodiment has the ink applying device 104 which applies ink onto the transfer body 101 to which the reaction liquid is applied. The first image is formed by mixing the reaction liquid with the ink, and then the liquid component is absorbed from the first image by the liquid absorbing device 105.

<Liquid Absorbing Device>

In the present embodiment, the liquid absorbing device (liquid removing unit) 105 has a liquid absorbing member 105*a* and a pressing member 105*b* for liquid absorption which presses the liquid absorbing member 105*a* toward the first image on the transfer body 101. It should be noted that the shapes of the liquid absorbing member 105*a* and the pressing member 105*b* are not particularly limited. For example, as shown in FIG. 1, the pressing member 105*b* has a columnar shape, the liquid absorbing member 105*a* has a belt shape, and the columnar pressing member 105*b* may be configured to press the belt-shaped liquid absorbing member 105*a* against the transfer body 101. In addition, the pressing member 105*b* has a columnar shape, the liquid absorbing member 105*a* has a cylindrical shape formed on a circumferential surface of a columnar pressing member 105*b*, and the columnar pressing member 105*b* may also be configured to press the cylindrical liquid absorbing member 105*a* against the transfer body.

In the present invention, it is preferable that the liquid absorbing member 105*a* has a belt shape in consideration of a space or the like in the ink jet recording apparatus.

Further, the liquid absorbing device 105 having the belt-shaped liquid absorbing member 105*a* may have an extending member which extends the liquid absorbing member 105*a*. In FIG. 1, reference numerals 105*c*, 105*d* and 105*e* denote extending rollers as the extending members. In FIG. 1, the pressing member 105*b* is a roller member which rotates like the extending roller, but is not limited thereto.

In the liquid absorbing device 105, the pressing member 105*b* brings the liquid absorbing member 105*a* having the porous body into pressure contact with the first image, so that the liquid component contained in the first image is absorbed by the liquid absorbing member 105*a*, thereby obtaining the second image in which the liquid component is reduced from the first image. As a method for decreasing a liquid component in a first image, in addition to the present method for pressure-contacting a liquid absorbing member, a combination of other various methods conventionally used such as a heating method, a method for blowing low humidity air and a method for reducing a pressure may be used. Further, it is also possible to apply these methods to the second image in which the liquid component is reduced to further reduce the liquid component.

Hereinafter, various conditions and configurations in the liquid absorbing device 105 will be described in detail.

(Pre-Treatment)

In the present embodiment, it is preferable to perform pre-treatment by a pre-treatment unit (not shown in FIGS. 1 and 2), which applies a treatment liquid to the liquid absorbing member, before the liquid absorbing member 105*a* having the porous body comes into contact with the first image. The treatment liquid used for the present invention preferably contains water and a water-soluble organic solvent. The water is preferably water deionized by ion exchange or the like. In addition, the kind of water-soluble organic solvents is not particularly limited, and any known organic solvent such as ethanol and isopropyl alcohol can be used. In the pre-treatment of the liquid absorbing member used for the present invention, the applying method is not particularly limited, but immersion or liquid droplet dripping is preferable.

(Pressing Condition)

It is preferable that the pressure of the liquid absorbing member 105*a* which pressure-contacts the first image on the transfer body is 2.9 N/cm$^2$ (0.3 kgf/cm$^2$) or more, because the liquid in the first image can be separated into solid-liquid in a shorter period of time and the liquid component can be removed from the first image. The pressure of the liquid absorbing member in this specification indicates a nip pressure between the discharge receiving medium and the liquid absorbing member 105*a*, and a surface pressure distribution measuring device (I-SCAN manufactured by Nitta Co., Ltd.) performs a surface pressure measurement and divides weighting in a pressurized region by an area to calculate a value.

(Application Time)

It is preferable that the application time of bringing the liquid absorbing member 105*a* into contact with the first image is within 50 ms in order to further suppress the adhesion of the coloring material in the first image to the liquid absorbing member. The application time in this specification is calculated by dividing a pressure sensing width in the movement direction of the transfer body 101 by the moving speed of the transfer body 101 in the surface pressure measurement described above. Hereinafter, the application time is referred to a liquid absorption nip time.

In this way, the second image, in which the liquid component is absorbed from the first image and the liquid component is reduced, is formed on the transfer body 101. Next, the second image is transferred onto the recording medium 108 in the transfer part. The device configuration and condition at the time of the transfer will be described.

<Transfer Part>

In the present embodiment, the transfer part has a member for transferring the second image on the transfer body 101 by bringing the second image into pressure contact with the recording medium 108 conveyed by the recording medium conveyance unit 107 by the pressing member 106 for transferring. The liquid component contained in the first image on the transfer body 101 is removed and then is transferred onto the recording medium 108, thereby obtaining the recording image in which curling, cockling or the like is suppressed.

The pressing member 106 obtains a certain degree of structural strength from the viewpoint of the conveyance accuracy and durability of the recording medium 108. As the material of the pressing member 106, metal, ceramic, resin or the like are preferably used. Among those, to improve control responsiveness by reducing an inertia during the operation in addition to improve rigidity or dimensional accuracy which can withstand the pressing during the transfer, in particular, aluminum, iron, stainless steel, acetal resin, epoxy resin, polyimide, polyethylene, polyethylene terephthalate, nylon, polyurethane, silica ceramics, alumina ceramics or the like are preferably used. The plurality of combinations may also be used.

Although the time when the second image on the transfer body 101 pressure-contacts the recording medium 108 is not particularly limited, it is preferably 5 ms or more to 100 ms or less in order that the transfer is performed satisfactorily and the durability of the transfer body is not damaged. The pressure contact time in the present embodiment indicates the time during which the recording medium 108 and the transfer body 101 are in contact with each other, the surface pressure was measured by the surface pressure distribution measuring device (I-SCAN manufactured by Nitta Co., Ltd.), and the length in the conveyance direction of the pressurized region was divided by the conveyance speed to calculate the value.

In addition, although there is no particular limitation as to the pressure for bringing the second image into pressure contact with the transfer body 101 onto the recording medium 108, the pressure is set so that the transfer is performed satisfactorily and the durability of the transfer body is damaged. For this reason, it is preferable that the pressure is 9.8 N/cm$^2$ (1 kg/cm$^2$) or more to 294.2 N/cm$^2$ (30 kg/cm$^2$) or less. In the present embodiment, the pressure indicates a nip pressure between the recording medium 108 and the transfer body 101, and the surface pressure distribution measuring device performs the surface pressure measurement and divides the weighting in the pressurized region by the area to calculate the value.

The temperature at which the second image on the transfer body 101 is brought into pressure contact with the recording medium 108 is also not particularly limited, but is preferably the glass transition point or more or the softening point or more of the resin component contained in the ink. In addition, for the heating, the form including the heating unit which heats the second image on the transfer body 101 and the heating unit which heats the transfer body 101 and the recording medium 108 are preferable.

The shape of the transfer unit 106 is not particularly limited, but may have, for example, a roller shape.

<Recording Medium and Conveyance Device for Recording Medium>

In the present embodiment, the recording medium 108 is not particularly limited and any known recording medium can be used. Examples of the recording medium may include a long object wound in a roll form or a sheet cut in a predetermined dimension. Examples of the material include paper, plastic film, wood board, corrugated cardboard, metal film or the like.

In addition, in FIG. 1, the conveyance device 107 for recording medium which conveys the recording medium 108 is configured to include a recording medium feeding roller 107*a* and a recording medium winding roller 107*b*, but is not particular limited to this configuration as long as it can convey the recording medium.

<Control System>

Figure 3:
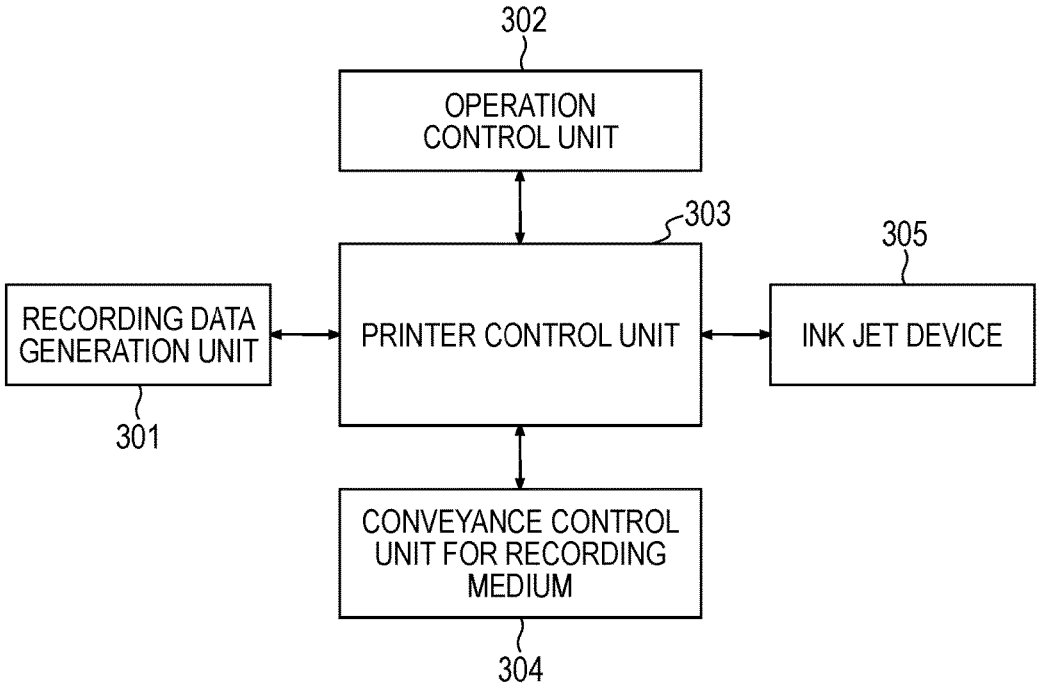
FIG. 3 is a block diagram showing a control system of the entire apparatus in the ink jet recording apparatus shown in FIGS. 1 and 2.

In the present embodiment, the transfer type ink jet recording apparatus includes a control system which controls each apparatus. FIG. 3 is a block diagram of a control system of the entire apparatus in the transfer type ink jet recording apparatus shown in FIG. 1.

In FIG. 3, a recording data generation unit 301 generates recording data such as an external print server. An operation control unit 302 is a unit which performs operation control on an operation panel or the like. A printer control unit 303 performs a control on a printer for executing a recording process. A conveyance control unit 304 for recording medium performs a control for conveying the recording medium. An ink jet device 305 is an ink applying device for printing.

Figure 4:
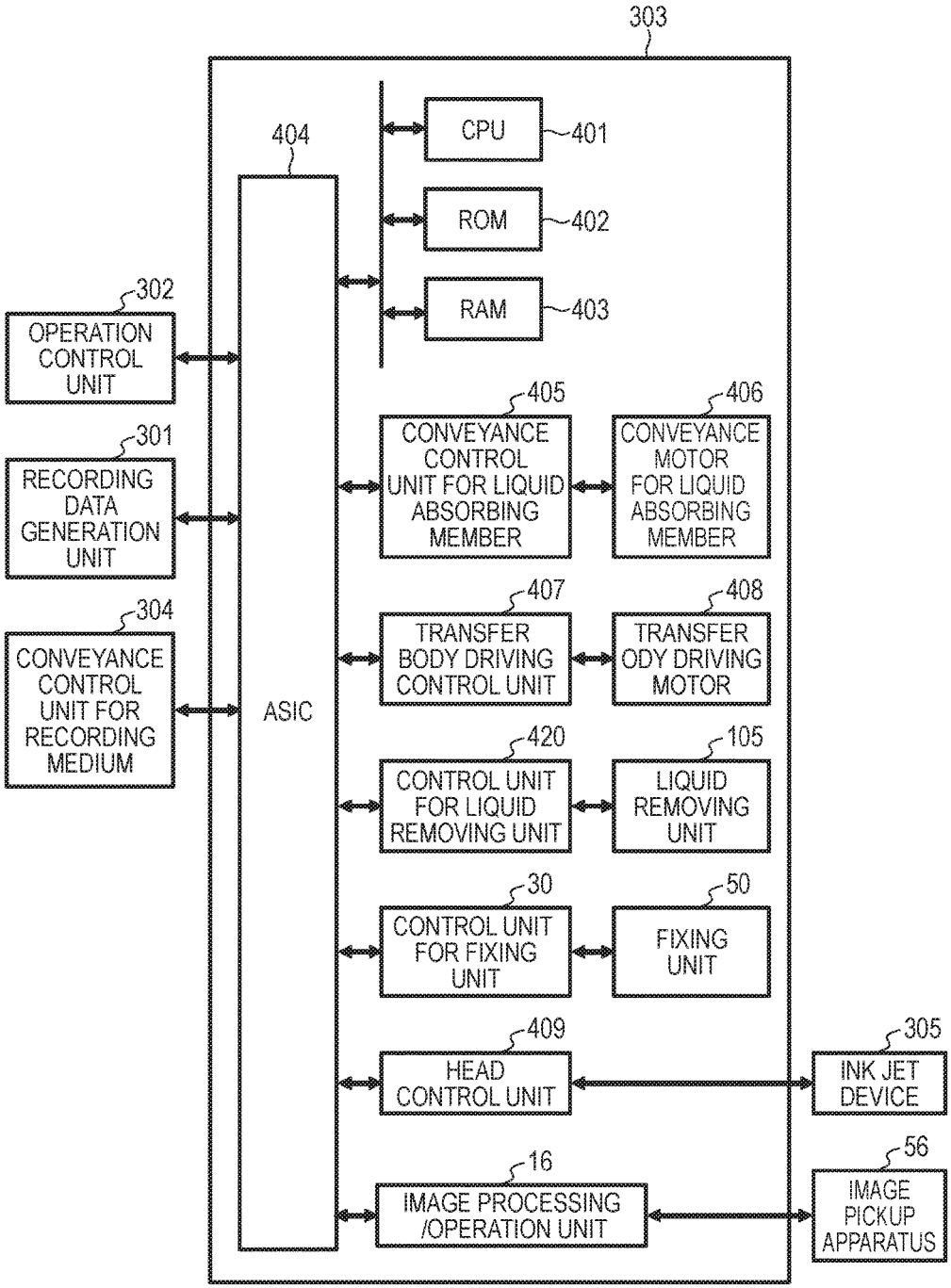
FIG. 4 is a block diagram of a printer control unit in the transfer type ink jet recording apparatus shown in FIG. 1.

FIG. 4 is a block diagram of the printer control unit in the transfer type ink jet recording apparatus of FIG. 1.

A CPU 401 controls the entire printer. A ROM 402 is a ROM for storing the control program of the CPU, and a RAM 403 is a RAM for executing the program. An ASIC 404 includes an application specific integrated circuit (ASIC) for specific application in which a network controller, a serial IF controller, a controller for generating head data, a motor controller and the like are embedded. A conveyance control unit 405 for liquid absorbing member drives a conveyance motor 406 for liquid absorbing member under the command control from the ASIC 404 via the serial IF interface. Similarly, a transfer body driving control unit 407 drives a transfer body driving motor 408 under the command control from the ASIC 404 via the serial IF. A head control unit 409 generates final discharge data of the ink jet device 305, generates a driving voltage or the like. A control unit 420 for liquid removing unit and a control unit 30 for fixing unit each control the liquid removing unit 105 and the fixing unit 50. An image processing/operation unit 16 performs analysis processing on an image obtained by an image pickup apparatus 56.

<Fixing Device>

A fixing device (fixing unit) presses a fixing substrate against the image formed on the recording medium to perform heating and pressing fixing. The fixing device can improve fixing property between the recording medium and the image. In the case where the fixing device has a heating roller, a typical fixing system using a heating roller may include a roller nip system and an endless press system, and both of the systems may be suitably used, but in order to manifest specular gloss, the endless press system is more suitable.

A heating and pressing unit (fixing unit) 50 of the endless press system will be described with reference to FIG. 1. A fixing belt (fixing substrate) 51 extends to a heating roller 52 and a peeling off roller 54, and the recording medium 108 is nipped between the heating roller 52 and a support roller 53, thereby performing the heating and pressing fixing.

The ink image passes between the heating roller 52 and the support roller 53 so that the surface of the ink image formed on the recording medium 108 comes into contact with the fixing belt 51, and the ink image and the fixing belt 51 are kept in contact with each other, and reach the peeling off roller 54 to be peeled from each other. If a temperature of ink image remains high at the time of the peeling off, peeling off failure that the ink image is transferred onto the fixing substrate 51 is likely to occur, thus it is preferable to install a cooling device 55 between the heating roller 52 and the peeling off roller 54. By installing the cooling device 55, the ink image is sufficiently cooled when the recording medium 108 reaches the position of the peeling off roller 54, so it is possible to normally peel off the fixing belt 51 and the ink image from each other.

As the surface member of the fixing belt 51, for example, a polyimide substrate such as Kapton (registered trademark, manufactured by Du Pont-Toray Co., Ltd.) is suitable.

<Liquid Adhesion Determination Unit>

The image pickup apparatus 56 observes the surface of the fixing substrate 51 of the fixing device and detects whether there is the adhesion of the liquid component. As the image pickup apparatus 56, a line sensor or the like can be used.

The image processing/operation apparatus (image processing/operation unit) 16 analyzes the captured image of the surface of the fixing substrate 51 captured by the line sensor, and determines whether there is the adhesion of the liquid component. The apparatus including the image pickup apparatus 56 and the image processing/operation apparatus 16 is collectively referred to as a liquid adhesion detection apparatus. Although the analysis method of the image is arbitrary, in particular, when there is the adhesion of the liquid component, unevenness occurs in the brightness of the captured image, so it is suitable to determine whether there is the adhesion of the liquid component based on the uneven brightness of the captured image. In addition, it is also suitable to determine whether there is the adhesion of the liquid component based on a 20-degree gloss value (according to Japanese Industrial Standards JIS Z 8741) on the surface of the fixing substrate 51. Even when any of the methods is used, it is possible to determine whether there is the adhesion of the liquid component based on the comparison with the captured image of the surface of the fixing substrate 51 without the adhesion of the liquid component as a reference or the 20-degree gloss value. As the liquid adhesion detection unit in place of the image pickup apparatus 56 and the image processing/operation apparatus 16, a unit which directly measures the moisture amount on the surface of the fixing substrate 51 using a moisture meter such as an infrared moisture meter is suitable. The reference on whether there is the adhesion of the liquid component can be appropriately set without being particularly limited. The printer control unit 303 (or device control unit 15) determines whether there is liquid adhesion based on the analysis result of the image (liquid adhesion determination unit). In addition, the printer control unit 303 (or device control unit 15) may have a function as a liquid removing condition changing unit to be described later.

<Procedure for Changing Liquid Removing Condition>

When it is determined that there is liquid adhesion to the fixing substrate 51 based on the liquid adhesion determination, it is determined that the liquid removal amount is small by the liquid removing unit 105 is small, so the control condition (liquid removing condition) of the liquid removing unit 105 is changed by one step to increase the liquid removal amount by the liquid removing unit 105. On the other hand, when it is determined that there is no liquid adhesion based on the determination on the liquid adhesion to the fixing substrate 51, it is determined that the liquid removal amount by the liquid removing unit 105 is excessive, so the liquid removing condition is changed by one step to reduce the liquid removal amount by the liquid removing unit 105. In this way, the liquid removing condition is changed by one step until the determination result is changed from "there is liquid adhesion" to "there is no liquid adhesion" or from "there is no liquid adhesion" to "there is liquid adhesion". If the determination result changes, it is determined that the liquid removing condition before one step of the changed condition is the optimum liquid removing condition.

The processing method for changing a liquid removing condition described above will be described with reference to FIG. 6. First, any liquid removing condition is set (step S10). It should be noted that the image forming condition and the fixing condition are also set in combination. Next, under the set condition, the image forming process (ink image forming process), the liquid component removing process (liquid removing step) and the fixing process are performed (step S20). Next, the observation of the surface of the fixing substrate used in the fixing process is performed (step S30). Next, it is determined whether the liquid adheres to the surface of the fixing substrate by analyzing the observed result (step S40) (liquid adhesion determination process). Next, when the determination result is "there is the adhesion", the liquid removing condition of the liquid component removing process is changed by one step so that the liquid is not adhered, that is, a large amount of liquid component is removed. In contrast, when the determination result is "there is no adhesion", the liquid removing condition is changed by one step in the direction in which the liquid is adhered, that is, to reduce the amount of liquid component to be removed (liquid removing condition changing process). The image forming process, the liquid component removing process and the fixing process are performed again without changing other conditions (step S50). Next, the surface of the fixing substrate is again observed, and it is determined whether a liquid adheres to the surface (step S60). Next, it is determined whether the determination result on the liquid adhesion is changed (step S70). When the determination result on the liquid adhesion is changed (step S70; Yes), that is, the determination result is changed from "there is the adhesion" to "there is no adhesion" or from "there is no adhesion" to "there is the adhesion", it is determined that the liquid removing condition at the just previous step is the optimum liquid removing condition. This is set as a new liquid removing condition (step S80), and the liquid removing condition change processing ends. When the determination result on the liquid adhesion has not changed (step S70; No), the procedure returns to step S50 and the subsequent procedure is repeated. After the new liquid removing condition is set, the following procedure may the liquid component removing process using the condition. When the transfer type ink jet recording apparatus is used, in steps S20 and S50, the transferring process is further performed together with the image forming process, the liquid component removing process and the fixing process.

As in the liquid removing conditions 1 to 4 in the liquid removing condition table shown in Table 1 to be described below, the liquid removing conditions may be sequentially prepared in advance so that liquid component removal rates are different. At this time, the liquid removing condition table may be created finely for each other conditions, for example, for each type of recording media (paper type, basis weight or the like), each image forming condition (maximum ink ejection amount or the like). A user can specify which condition table to evaluate. Such a condition table is stored in the ROM or the like of the ink jet recording apparatus in advance.

The timing of the liquid removing condition change processing is arbitrary. For example, the ink jet recording apparatus may be set to start automatically at each operation of the ink jet recording apparatus. In addition, when the user wishes to change the setting or confirm whether the current setting is optimum, the ink jet recording apparatus may be configured to start the liquid removing condition change processing. In addition, as a method for changing a liquid removing condition, for example, a method for changing at least one of a pressing force by a pressing member of the liquid removing unit, and a contact time of the liquid absorbing member included in the liquid removing unit with the first image may be used.

(Direct Drawing Type Ink Jet Recording Apparatus)

Another embodiment of the present invention may be a direct drawing type ink jet recording apparatus. In the direct drawing type ink jet recording apparatus, a discharge receiving medium is a recording medium on which an image is to be formed.

Figure 2:
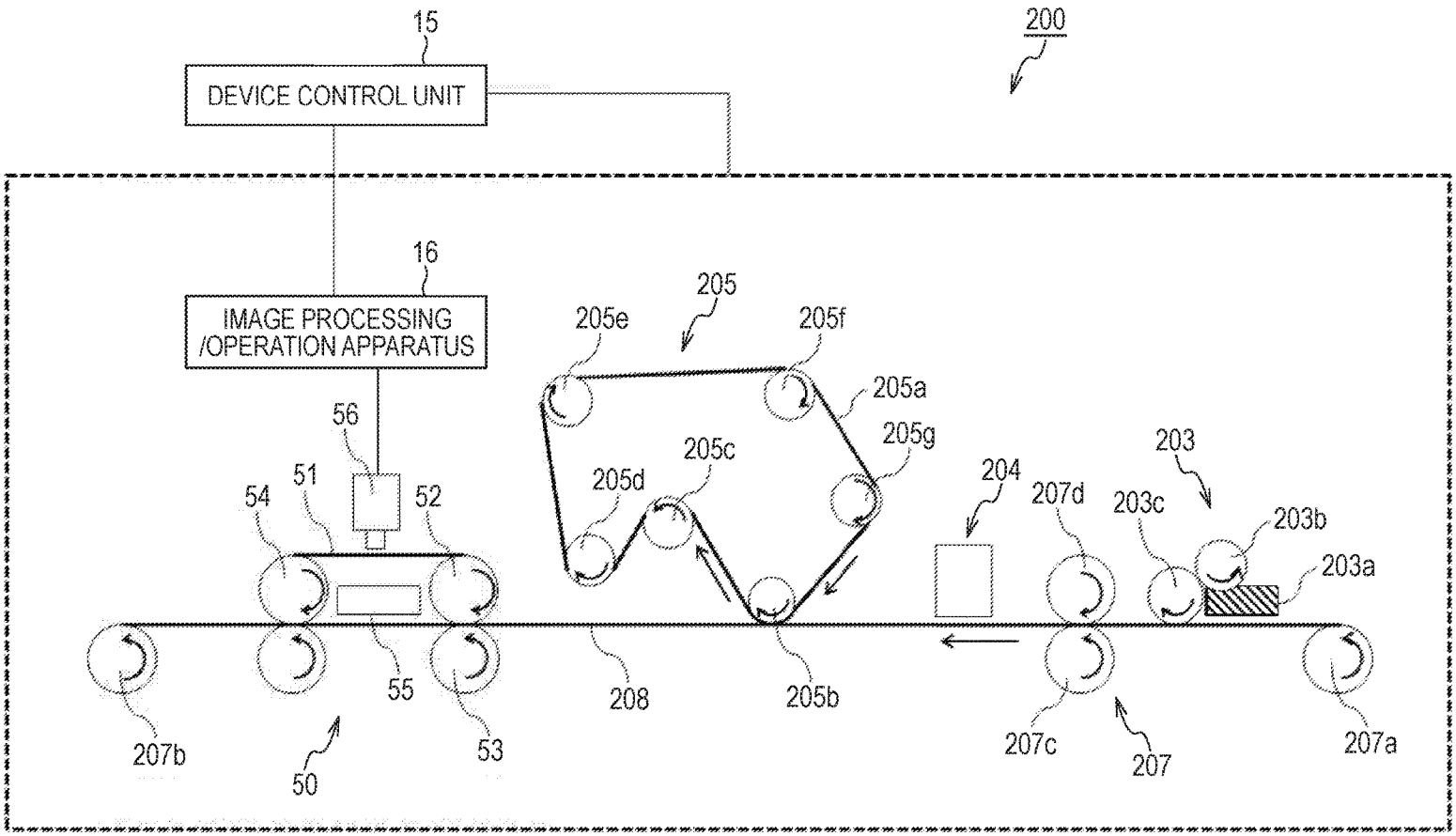
FIG. 2 is a schematic diagram showing an example of a configuration of a direct drawing type ink jet recording apparatus according to an embodiment of the present invention.

FIG. 2 is a schematic diagram showing an example of a schematic configuration of a direct drawing type ink jet recording apparatus 200 according to an embodiment of the present invention. The direct drawing type ink jet recording apparatus 200 is different from the transfer type ink jet recording apparatus 100 described above in that it does not include the transfer body 101, the support member 102 and the transfer body cleaning member 109. The direct drawing type ink jet recording apparatus 200 has the same units as those of the transfer type ink jet recording apparatus except that an image is formed on a recording medium 208.

Specifically, the direct drawing type ink jet recording apparatus 200 includes a reaction liquid applying device 203, an ink applying device (ink image forming unit) 204 and a liquid absorbing device (liquid removing unit) 205. The reaction liquid applying device 203 applies a reaction liquid onto the recording medium 208. The ink applying device 204 applies ink onto the recording medium 208. The liquid absorbing device 205 absorbs a liquid component contained in a first image by a liquid absorbing member 205*a* which comes into contact with the first image on the recording medium 208. These components are the same configuration as the transfer type ink jet recording apparatus 100, and therefore a description thereof is omitted.

In the direct drawing type ink jet recording apparatus 200 of the present embodiment, the liquid absorbing device 205 has a liquid absorbing member 205*a* and a pressing member 205*b* which presses the liquid absorbing member 205*a* against the first image on the recording medium 208. Further, the shapes of the liquid absorbing member 205*a* and the pressing member 205*b* are not particularly limited, and a liquid absorbing member and a pressing member having the same shape as the liquid absorbing member and the pressing member usable in the transfer type ink jet recording apparatus can be used. In addition, the liquid absorbing device 205 may have an extending member which extends the liquid absorbing member. In FIG. 2, reference numerals 205*c*, 205*d*, 205*e*, 205*f* and 205*g* are an extending roller as the extending member. The number of extending rollers is not limited to five of FIG. 4, but it is sufficient to dispose the necessary number of extending rollers according to the apparatus design. In addition, a printing unit which applies ink to a recording medium 208 by the ink applying device 204 and a liquid component removing unit which brings the liquid absorbing member 205*a* into pressure contact with the first image on the recording medium and removes the liquid component may have a recording medium support member (not shown) which supports the recording medium from below.

<Conveyance Device for Recording Medium>

In the direct drawing type ink jet recording apparatus of the present embodiment, a conveyance device 207 for recording medium is not particularly limited, and may use a conveyance unit in the known direct drawing type ink jet recording apparatus. As an example, as shown in FIG. 2, there may be a conveyance device for recording medium which includes a recording medium feeding roller 207*a*, a recording medium winding roller 207*b* and recording medium conveyance rollers 207*c* and 207*d*.

<Control System>

The direct drawing type ink jet recording apparatus 200 according to the present embodiment has a control system for controlling each device. In the direct drawing type ink jet recording apparatus shown in FIG. 2, a block diagram showing the control system of the entire apparatus is as shown in FIG. 3, like the transfer type ink jet recording apparatus shown in FIG. 1.

Figure 5:
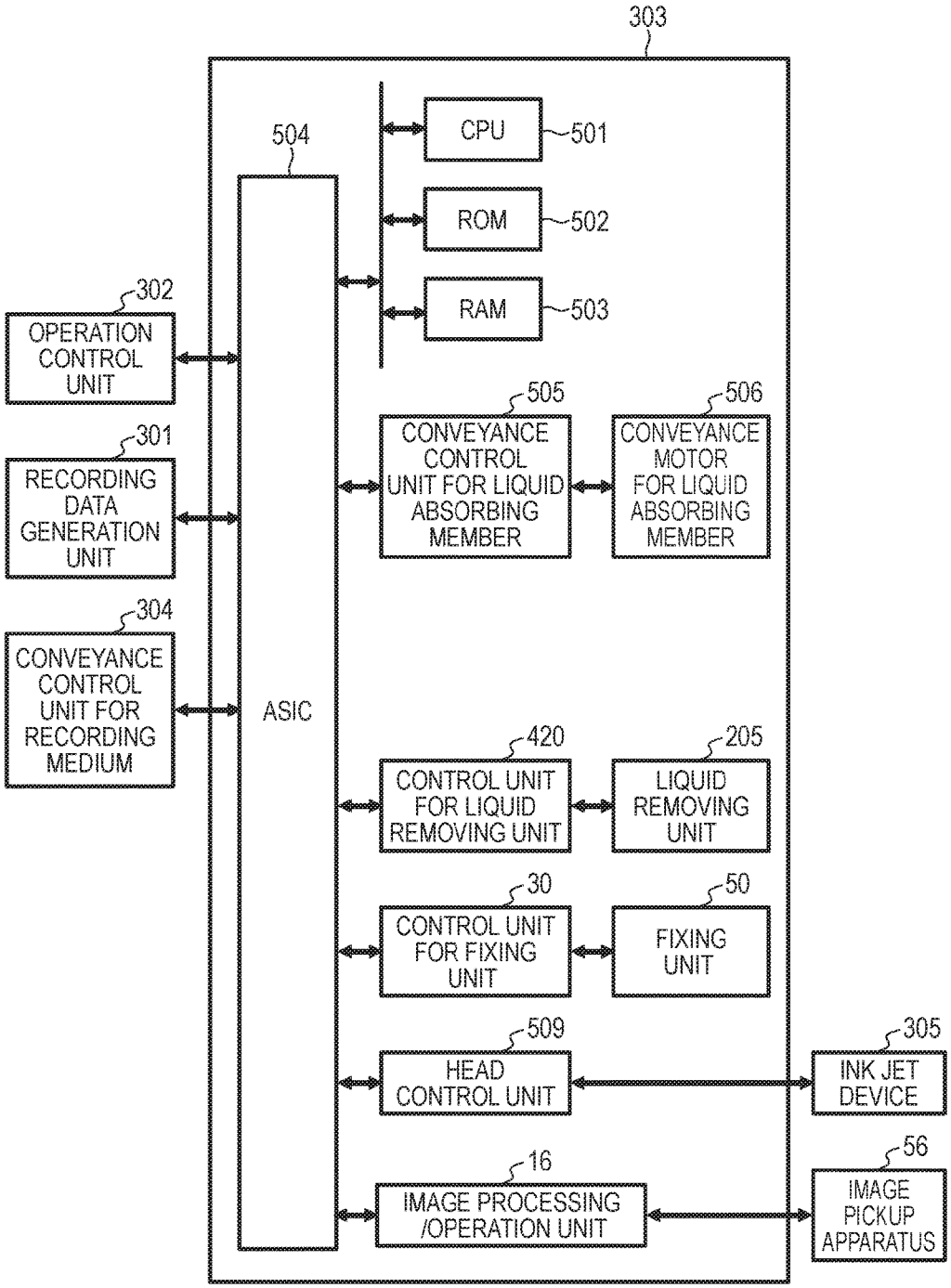
FIG. 5 is a block diagram of a printer control unit in the direct drawing type ink jet recording apparatus shown in FIG. 2.

FIG. 5 is a block diagram of a printer control unit in the direct drawing type ink jet recording apparatus of FIG. 2. The printer control unit is the same as the block diagram of the printer control unit in the transfer type ink jet recording apparatus in FIG. 4 except that it does not have a transfer body driving control unit 407 and a transfer body driving motor 408.

That is, a CPU 501 controls the entire printer. A ROM 502 is a ROM for storing the control program of the CPU, and a RAM 503 is a RAM for executing the program. ASIC 504 is an ASIC in which a network controller, a serial IF controller, a controller for generating head data, a motor controller or the like are embedded. A conveyance control unit 505 for liquid absorbing member drives a conveyance motor 506 for liquid absorbing member under the command control from the ASIC 504 via the serial IF interface. A head control unit 509 generates final discharge data of the ink jet device 305, generates a driving voltage or the like. A control unit 420 for liquid removing unit and a control unit 30 for fixing unit each control the liquid removing unit 205 and the fixing unit 50. An image processing/operation unit 16 performs analysis processing on an image obtained by an image pickup apparatus 56.

According to the present invention, it is possible to provide an ink jet recording apparatus and an ink jet recording method capable of forming an image that maintains high glossiness immediately after fixing even after the passage of time.

EXAMPLES

Hereinafter, the present invention will be described in more detail with reference to Examples and Comparative Examples. The present invention is not limited to the following Examples as long as it does not deviate from the gist of the invention. In the description of the following Examples, "part" is on a mass basis unless otherwise specified.

Example 1

In the present example, the transfer type ink jet recording apparatus shown in FIG. 1 was used. In the present example, the transfer body 101 is fixed to the support member 102 by the adhesive.

In the present example, a sheet in which silicone rubber (KE12 made by Shin-Etsu Chemical Co., Ltd.) is coated onto a PET sheet having a thickness of 0.5 mm with a thickness of 0.3 mm was used as an elastic layer of a transfer body 101. Further, glycidoxypropyltriethoxysilane and methyltriethoxysilane were mixed at a molar ratio of 1:1, and a mixture of a condensate obtained by heating reflux and a photocationic polymerization initiator (SP150 manufactured by ADEKA) was prepared. The mixture was applied onto the elastic layer by performing atmospheric pressure plasma treatment so that the contact angle of water on the surface of the elastic layer was 10° or less. A film was formed by UV irradiation (high-pressure mercury lamp, integrated exposure amount of 5000 mJ/cm$^2$) and thermosetting (150° C. for 2 hours) to produce the transfer body 101 having a surface layer of 0.5 μm in thickness formed on the elastic body.

In this configuration, although not shown for the sake of simplicity of explanation, a double-sided tape was used to hold the transfer body 101 between the transfer body 101 and the support member 102.

In addition, in the present configuration, the surface of the transfer body 101 becomes 60° C. by the heating unit (not shown).

The reaction liquid applied by the reaction liquid applying unit 103 was formed of the following composition, and the application amount was 1 g/m$^2$. The balance is set to be an amount which makes the total sum 100 parts.

| | |
|---|---|
| Glutaric acid | 21.0 parts |
| Potassium hydroxide | 2.0 parts |
| Glycerin | 5.0 parts |
| Surfactant (product name: Megafac F444, manufactured by DIC Corporation) | 5.0 parts |
| Ion-exchanged water | balance |

The ink was prepared as follows.

<Preparation of Pigment Dispersion>

10 parts of carbon black (product name: Monarch (registered mark) 1100, manufactured by Cabot Corporation), 15 parts of resin aqueous solution (an aqueous solution having a styrene-ethyl acrylate-acrylic acid copolymer with an acid value of 150, a weight average molecular weight (Mw) of 8,000 and a resin content of 20.0% by mass was neutralized with an aqueous solution of potassium hydroxide) and 75 parts of pure water were mixed, charged into a batch type vertical sand mill (manufactured by Aimex), filled with 200 parts of zirconia bead having a diameter of 0.3 mm, and subjected to the dispersion treatment for 5 hours while being cooled with water. After the coarse particles were removed by centrifuging this dispersing liquid, a black pigment dispersion having a pigment content of 10.0% by mass was obtained.

<Preparation of Resin Particle Dispersion>

20 parts of ethyl methacrylate, 3 parts of 2,2'-azobis-(2-methylbutyronitrile) and 2 parts of n-hexadecane were mixed and stirred for 0.5 hours. The mixture was dropped to 75 parts of 8% aqueous solution of a styrene-butyl acrylate-acrylic acid copolymer (acid value: 130 mg KOH/g, weight average molecular weight (Mw): 7,000) and stirred for 0.5 hours. Next, ultrasonic waves were irradiated for 3 hours by an ultrasonic irradiator. Next, polymerization was performed at 80° C. for 4 hours under the nitrogen atmosphere and filtration was performed after cooling at room temperature to prepare the resin particle dispersion having a resin content of 25.0% by mass.

<Preparation of Ink>

The obtained resin particle dispersion and the pigment dispersion were mixed with each of the following components. The ion-exchanged water balance was set to be an amount which makes the total of all the components constituting the ink 100.0% by mass.

| | |
|---|---|
| Pigment dispersion (a content of coloring material is 10.0% by mass) | 40.0% by mass |
| Resin particle dispersion | 20.0% by mass |
| Glycerin | 12.0% by mass |
| Surfactant Acetylenol E100 (manufactured by Kawaken Fine Chemicals Co., Ltd.) | 0.5% by mass |
| Ion-exchanged water | balance |

After the mixture was sufficiently stirred and dispersed, it was subjected to the pressure filtration by a micro filter (manufactured by Fujifilm Corporation) having a pore size of 3.0 μm to prepare the black ink.

The ink applying unit (image forming unit) 104 used the ink jet head of the type which discharges ink by an on-demand method using an electrothermal transducer element, and the ink applying amount was set to be 20 g/m$^2$.

The liquid absorbing member 105*a* was controlled to be equal to the moving speed of the transfer body 101 by the conveyance rollers 105*c*, 105*d* and 105*e* which convey the liquid absorbing member while extending the liquid absorbing member. In addition, to achieve the same speed as the moving speed of the transfer body 101, the recording medium 108 is conveyed by the recording medium feeding roller 107*a* and the recording medium winding roller 107*b*. In the present example, the conveyance speed was set to be 0.5 m/s, and Gloria Pure white paper basis weight 210 g/m$^2$ (manufactured by Gojo Paper Mfg. Co., Ltd.) was used as the recording medium 108.

In this example, the liquid absorbing member 105*a* was immersed in a treatment liquid consisting of 95 parts of ethanol and 5 parts of water, followed by being replaced with a liquid consisting of 100 parts of water, and then used for liquid removal. In addition, a pressure is applied to the liquid absorbing member 105*a* so that the average pressure of the nip pressure between the transfer body 101 and the liquid absorbing member 105*a* is 2 kg/cm$^2$. In addition, as the pressing member 105*b* in the liquid absorbing unit, a pressing member 105*b* having a roller diameter 4 of 200 mm was used.

As the liquid absorbing member 105*a*, one in which nonwoven fabric HOP (manufactured by Hirose Paper Mfg. Co., Ltd.) is laminated on PTFE having an average pore diameter of 0.4 μm by the lamination by heating was used. Gurley of the absorbing member 105*a* was 5 seconds.

Next, main parts of the present embodiment will be described in detail with reference to the drawings. Hereinafter, a method for setting a liquid removing condition in the present embodiment will be described with reference to the drawings.

FIG. 1 schematically shows an ink jet recording apparatus according to an embodiment of the present invention. First, in the printer control unit 303 (or device control unit 15) (liquid removing condition changing unit), the liquid removing condition of the liquid absorbing device was set (step S10 in FIG. 6). Here, it was set as a liquid removing condition 1 in Table 1. The liquid removing condition 1 is a condition that 90% by mass of the liquid component in the ink image was removed by the liquid absorbing device 105, and then moisture in the liquid component remaining in the ink image is substantially entirely evaporated by an infrared drying device (heating and drying unit) 30.

Next, the reaction liquid, which comes into contact with the coloring material component in the ink to form a highly viscous ink image, was applied onto the transfer body 101 by the reaction liquid applying device 103. Next, the transfer body 101 reached the position of the ink applying device 204, and each of the black ink, the cyan ink, the magenta ink and the yellow ink is discharged from the ink jet recording head and reacted with the reaction liquid previously coated on the transfer body 101, so the ink image (ink aggregated layer) was formed on the transfer body 101. Next, the transfer body 101 reached the liquid absorbing device 105, and the liquid component contained in the ink image was removed according to the set liquid removing condition. The remaining moisture was substantially entirely evaporated by the infrared drying device 30. Next, the transfer body 101 reached the position of the pressing member 106, and the ink image were transferred to the recording medium 108 being conveyed from the recording medium feeding roller 107*a* to the recording medium winding roller 107*b*.

The recording medium 108 to which the ink image was transferred reached the position of the heating and pressing unit (fixing unit) 50, and the ink image was fixed by pressing and heating. Kapton (registered trademark, manufactured by Du Pont Toray) was adopted as the surface substrate of the fixing belt 51, the temperature at the time of fixing was 140° C. which is sufficiently higher than the minimum filming temperature (MFT) of the resin particles contained in the ink, and the pressure to be pressed was 10 kgf/cm$^2$. In addition, the time for which the ink image is nipped by the heating and pressing roller 52 and the support roller 53 via the fixing belt 51 was set to be 900 msec. The evaluation image was created by the above units (hereinabove, step S20). As the evaluation image, a black solid image obtained by applying the reaction liquid and then applying the black ink at 100% duty was used.

Subsequently, the surface of the fixing belt 51 is captured using the image pickup apparatus 56 (step S30), and it is determined whether there is liquid adhesion using the image processing/operation apparatus 16 (step S40). In this example, the method for determining whether there is liquid adhesion based on the unevenness of the brightness of the image captured by using the line sensor was adopted. In the liquid removing condition 1, the determination result on the liquid adhesion was no liquid adhesion.

In the liquid removing condition 1, since there was no liquid adhesion, the device control unit (liquid removing condition changing unit) 15 reset the liquid removing condition to a condition of a liquid removing condition 2 in Table 1 to reduce the liquid removal amount. The evaluation image was created by again performing the image forming process, the liquid component absorbing process and the fixing process (step S50). The liquid removing condition 2 is a condition that 80% by mass of the liquid component in the ink image was removed by the liquid absorbing device 105, and then moisture in the liquid component remaining in the ink image is substantially all evaporated by an infrared drying device 30. After the evaluation image was formed, the determination on the liquid adhesion to the surface of the fixing belt 51 was made (step S60), such that it is determined that there is no liquid adhesion (step S70; No) as in the previous process.

Further, even in the case of changing to a liquid removing condition 3, similarly, it was determined that there is no liquid adhesion in the determination on the liquid adhesion (steps S50 to S70). The liquid removing condition 3 is a condition that 75% by mass of the liquid component in the ink image was removed by the liquid absorbing device 105, and then moisture in the liquid component remaining in the ink image is substantially all evaporated by an infrared drying device 30.

Subsequently, the evaluation image was created by resetting the liquid removing condition to a liquid removing condition 4 in Table 1 (step S50). The liquid removing condition 4 is a condition that 50% by mass of the liquid component in the ink image was removed by the liquid absorbing device 105, and then moisture in the liquid component remaining in the ink image is substantially all evaporated by an infrared drying device 30. The determination on the liquid adhesion to the surface of the fixing belt 51 was made (step S60), such that it is determined that there is liquid adhesion (step S70; Yes). The liquid removing condition was set according to step S80 in FIG. 6 because the determination result is different from the previous determination on the liquid adhesion as the liquid removing condition. As the liquid removing condition, it was determined that the liquid removing condition 3 in Table 1 is optimum, the liquid removing condition 3 was set as a new liquid removing condition (step S80), and the flow of the liquid removing condition change processing ended.

When printing is performed under the set liquid removing condition 3, as shown in Table 1, the 20-degree gloss value immediately after the fixing becomes 51, the 20-degree gloss value after 16 hours becomes 51, and an image with high gloss and no change in gloss could be obtained. On the other hand, when printing is performed under the liquid removing condition 1, it was found that the 20-degree gloss value immediately after the fixing becomes 25, the 20-degree gloss value after 16 hours becomes 26, and the gloss is not changed but the high gloss does not appear. When printing is performed under the finally set liquid removing condition 4, it was found that the 20-degree gloss value immediately after the fixing becomes 50, the 20-degree gloss value after 16 hours becomes 37, and the high gloss appears immediately after the fixing but the gloss is lowered after 16 hours. 20-degree gloss value is measured according to JIS Z 8741.

Figure 6:
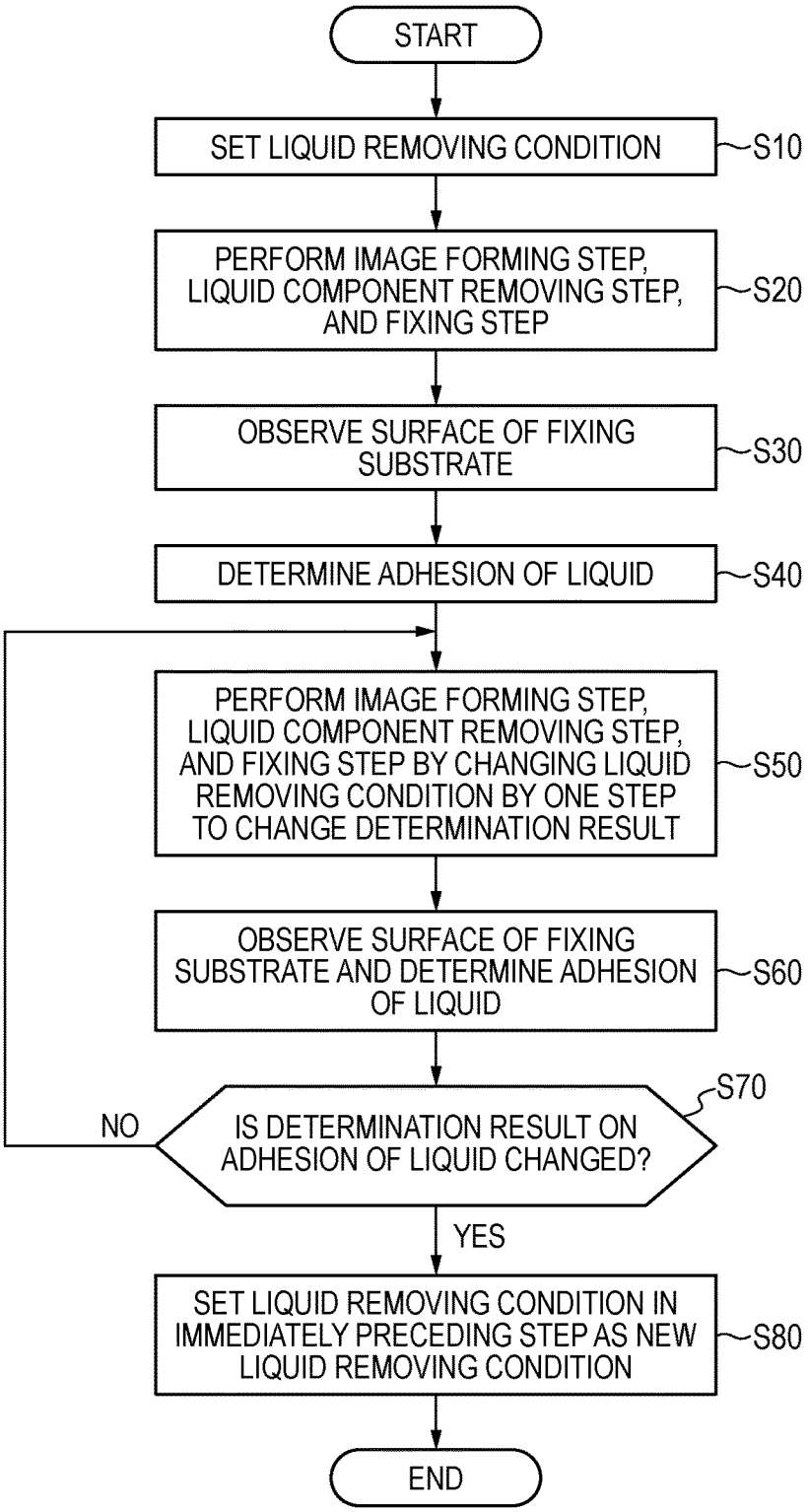
FIG. 6 is a flowchart for setting a liquid removing condition in the embodiment of the present invention.

That is, as shown in FIG. 6, it was possible to obtain the high-quality image with high gloss and no change in gloss by setting the liquid removing condition according to the surface state of the fixing substrate after the fixing.

TABLE 1

| Liquid removing condition | 20-degree gloss value (Immediately after fixing) | 20-degree gloss value (At the time of passage of 16 hours after fixing) | Determination on liquid adhesion of fixing substrate |
|---|---|---|---|
| Liquid removing condition 1 | 25 | 26 | No |
| Liquid removing condition 2 | 49 | 49 | No |
| Liquid removing condition 3 | 51 | 51 | No |
| Liquid removing condition 4 | 50 | 37 | Yes |

Example 2

In addition, instead of the transfer type ink jet recording apparatus, a similar experiment was performed using the direct drawing type ink jet recording apparatus as shown in FIG. 2 which directly coats the reaction liquid on the recording medium and applies ink. The reaction liquid composition, the reaction liquid applying unit 203, the ink composition, the ink applying unit (image forming unit) 204, the conveyance speed of the recording medium, and the liquid removing unit 205 were set to be the same conditions as those of the transfer type ink jet recording apparatus used in the above Example 1. As a result, it was confirmed that the same results as the above Example 1 were obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131274, filed Jul. 4, 2017, which is hereby incorporated by reference herein in its entirety.

What is claimed is:

1. An ink jet recording apparatus, comprising:

an ink image forming unit which forms an ink image by applying ink containing at least a resin and a liquid component onto a transfer body;

a liquid removing unit which removes at least a part of the liquid component in the ink image;

a transfer unit which transfers the ink image, from which at least a part of the liquid component is removed, onto a recording medium;

a fixing unit which performs heating and pressing fixing on the ink image formed on the recording medium by pressing a fixing substrate;

a liquid adhesion determination unit which determines whether a liquid adheres to a surface of the fixing substrate; and a liquid removing condition changing unit which changes a liquid removing condition of the liquid removing unit based on the determination result of the liquid adhesion determination unit.

2. An ink jet recording apparatus, comprising:

an ink image forming unit which forms an ink image by applying ink containing at least a resin and a liquid component onto a recording medium;

a liquid removing unit which removes at least a part of the liquid component in the ink image;

a fixing unit which performs heating and pressing fixing on the ink image formed on the recording medium by pressing a fixing substrate;

a liquid adhesion determination unit which determines whether a liquid adheres to a surface of the fixing substrate; and a liquid removing condition changing unit which changes a liquid removing condition of the liquid removing unit based on the determination result of the liquid adhesion determination unit.

3. The ink jet recording apparatus of claim 1, wherein the liquid removing condition changing unit changes the liquid removing condition to increase a liquid removal amount of the liquid removing unit when the determination result is the determination that there is liquid adhesion, and decrease the liquid removal amount of the liquid removing unit when the determination result is the determination that there is no liquid adhesion.

4. The ink jet recording apparatus of claim 1, wherein the liquid adhesion determination unit determines the liquid adhesion based on unevenness of brightness of an image obtained by capturing the fixing substrate.

5. The ink jet recording apparatus of claim 1, wherein the liquid adhesion determination unit determines the liquid adhesion based on a gloss value of the fixing substrate.

6. The ink jet recording apparatus of claim 1, wherein the liquid adhesion determination unit determines the liquid adhesion based on a moisture amount of the surface of the fixing substrate measured by a moisture meter.

7. The ink jet recording apparatus of claim 1, wherein the fixing unit includes a cleaning unit which cleans impurity derived from the ink which adheres to the fixing substrate.

8. The ink jet recording apparatus of claim 1, wherein the fixing unit is an endless press system.

9. The ink jet recording apparatus of claim 1, further comprising:

a heating and drying unit which heats and dries the ink image after the liquid component is removed.

10. An ink jet recording method, comprising:

forming an ink image by applying ink containing at least a resin and a liquid component onto a recording medium or a transfer body;

removing at least a part of the liquid component in the ink image from the ink image;

performing heating and pressing fixing on the ink image formed on the recording medium or the ink image transferred from the transfer body onto the recording medium by pressing a fixing substrate;

determining whether a liquid adheres to a surface of the fixing substrate; and changing a liquid removing condition of the removing of the liquid based on the determination result of the liquid adhesion determination unit.

11. The ink jet recording method of claim 10, wherein in the forming of the ink image, the ink image is formed by applying the ink onto the recording medium.

12. The ink jet recording method of claim 10, wherein in the forming of the ink image, the ink image is formed by applying the ink onto the transfer body.

13. The ink jet recording method of claim 12, further comprising:

transferring the ink image, from which at least a part of the liquid component is removed by the removing of the liquid, from the transfer body onto the recording medium.

14. The ink jet recording apparatus of claim 2, wherein the liquid removing condition changing unit changes the liquid removing condition to increase a liquid removal amount of the liquid removing unit when the determination result is the determination that there is liquid adhesion, and to decrease the liquid removal amount of the liquid removing unit when the determination result is the determination that there is no liquid adhesion.

15. The ink jet recording apparatus of claim 2, wherein the liquid adhesion determination unit determines the liquid adhesion based on unevenness of brightness of an image obtained by capturing the fixing substrate.

16. The ink jet recording apparatus of claim 2, wherein the liquid adhesion determination unit determines the liquid adhesion based on a gloss value of the fixing substrate.

17. The ink jet recording apparatus of claim 2, wherein the liquid adhesion determination unit determines the liquid adhesion based on a moisture amount of the surface of the fixing substrate measured by a moisture meter.

18. The ink jet recording apparatus of claim 2, wherein the fixing unit includes a cleaning unit which cleans impurity derived from the ink which adheres to the fixing substrate.

19. The ink jet recording apparatus of claim 2, wherein the fixing unit is an endless press system.

20. The ink jet recording apparatus of claim 2, further comprising:

a heating and drying unit which heats and dries the ink image after the liquid component is removed.

* * * * *